US010112106B1

(12) United States Patent
Riegel

(10) Patent No.: US 10,112,106 B1
(45) Date of Patent: Oct. 30, 2018

(54) GAMING KIT FOR USE WITH ROLLING TARGET TOSSING GAME

(71) Applicant: Riegel Enterprises, LLC, Lamar, MO (US)

(72) Inventor: Timothy Edward Riegel, Lamar, MO (US)

( * ) Notice: Subject to any disclaimer, the term of this patent is extended or adjusted under 35 U.S.C. 154(b) by 0 days.

(21) Appl. No.: 15/941,109

(22) Filed: Mar. 30, 2018

(51) Int. Cl.
*A63B 63/00* (2006.01)
*A63F 9/02* (2006.01)
*A63B 67/06* (2006.01)

(52) U.S. Cl.
CPC ..... *A63F 9/0204* (2013.01); *A63B 63/00* (2013.01); *A63B 67/06* (2013.01); *A63B 67/066* (2013.01); *A63F 2250/326* (2013.01)

(58) Field of Classification Search
CPC ..... A63B 63/00; A63B 67/06; A63B 67/066; A63F 9/0204
USPC ..... 273/398–402, 359, 348, 354, 382; 473/612
See application file for complete search history.

(56) References Cited

U.S. PATENT DOCUMENTS 1,644,466 A * 10/1927 Dewes ..... A63B 43/002 473/116
3,046,016 A * 7/1962 Laws ..... A63F 3/00094 273/241
3,231,278 A * 1/1966 Bonlanger ..... A63B 67/002 273/118 A
3,406,973 A * 10/1968 Poole ..... A63D 1/00 273/123 R
3,451,680 A * 6/1969 Koleske ..... A63F 9/0204 273/118 R
3,970,307 A * 7/1976 Breglia ..... A63B 67/06 273/399
5,772,543 A * 6/1998 Paino ..... A63B 37/02 273/DIG. 30
5,938,202 A * 8/1999 Williams ..... A63B 67/06 273/336
6,729,984 B2 * 5/2004 Silverglate ..... A63B 43/00 273/157 R
6,843,478 B1 * 1/2005 Hoepelman ..... A63B 63/00 273/342
6,988,964 B2 * 1/2006 Buckfield ..... A63B 67/06 473/415
8,434,763 B2 * 5/2013 Butler ..... A63B 67/06 273/126 R
9,320,953 B2 * 4/2016 Belete ..... A63B 67/066
9,533,236 B2 * 1/2017 Brunner ..... A63H 33/18
2003/0184013 A1 * 10/2003 Chodosh ..... A63B 67/06 273/139
2006/0038341 A1 * 2/2006 Konstant ..... A63B 67/06 273/126 R (Continued)

*Primary Examiner* — Mark Graham
(74) *Attorney, Agent, or Firm* — Wright, Lindsey & Jennings LLP; K. Brandon Middleton

(57) ABSTRACT

A gaming kit including a number of rolling pieces, a number of tossing pieces, and a number of target zone markers, the gaming kit to be used by two or more players for gameplay on a large gaming surface, gameplay including rolling the rolling pieces toward the target zone markers and tossing the tossing pieces toward the rolling pieces, with players' scores being dependent upon where in relation to the target zone marker the rolling pieces come to rest and where in relation to the rested rolling pieces the tossing pieces come to rest.

10 Claims, 3 Drawing Sheets

(56) References Cited

U.S. PATENT DOCUMENTS

2014/0183822 A1* 7/2014 Etheridge ..... A63B 67/06
273/359

* cited by examiner

GAMING KIT FOR USE WITH ROLLING TARGET TOSSING GAME

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Whether at house parties, tailgates, or just a family cookout, lawn-style games are a popular way to spend time outdoors. Lawn-style games (or games that are generally played outdoor on a flat yard or lawn) come in a variety of styles, but many lawn games include some sort of ball, bag, or other object to be tossed, thrown, or rolled. One popular lawn game, called cornhole or baggo, utilizes two angled platforms positioned at a distance apart, with the top of the platforms facing one another. The angled platforms generally have a single hole near the top center portion of the platform. The object of the game is to stand at one platform and toss bags toward the platform at the opposite end, particularly aiming to have your bags land in the hole or on the platform, with points awarded based on where the bag lands.

While cornhole is popular, the game does have its limitations. For example, it uses only one type of tossing game piece, which can lead to the game become repetitive over time. A new and exciting lawn game is therefore desirable.

BRIEF SUMMARY OF THE INVENTION

Generally speaking, the present invention is directed to a gaming kit including components used for a block-rolling and bag-tossing combination game.

These and other objects, features, and advantages of the present invention will become better understood from a consideration of the following detailed description of the preferred embodiments and appended claims in conjunction with the drawings as described following:

DETAILED DESCRIPTION OF THE INVENTION

Figure 1:
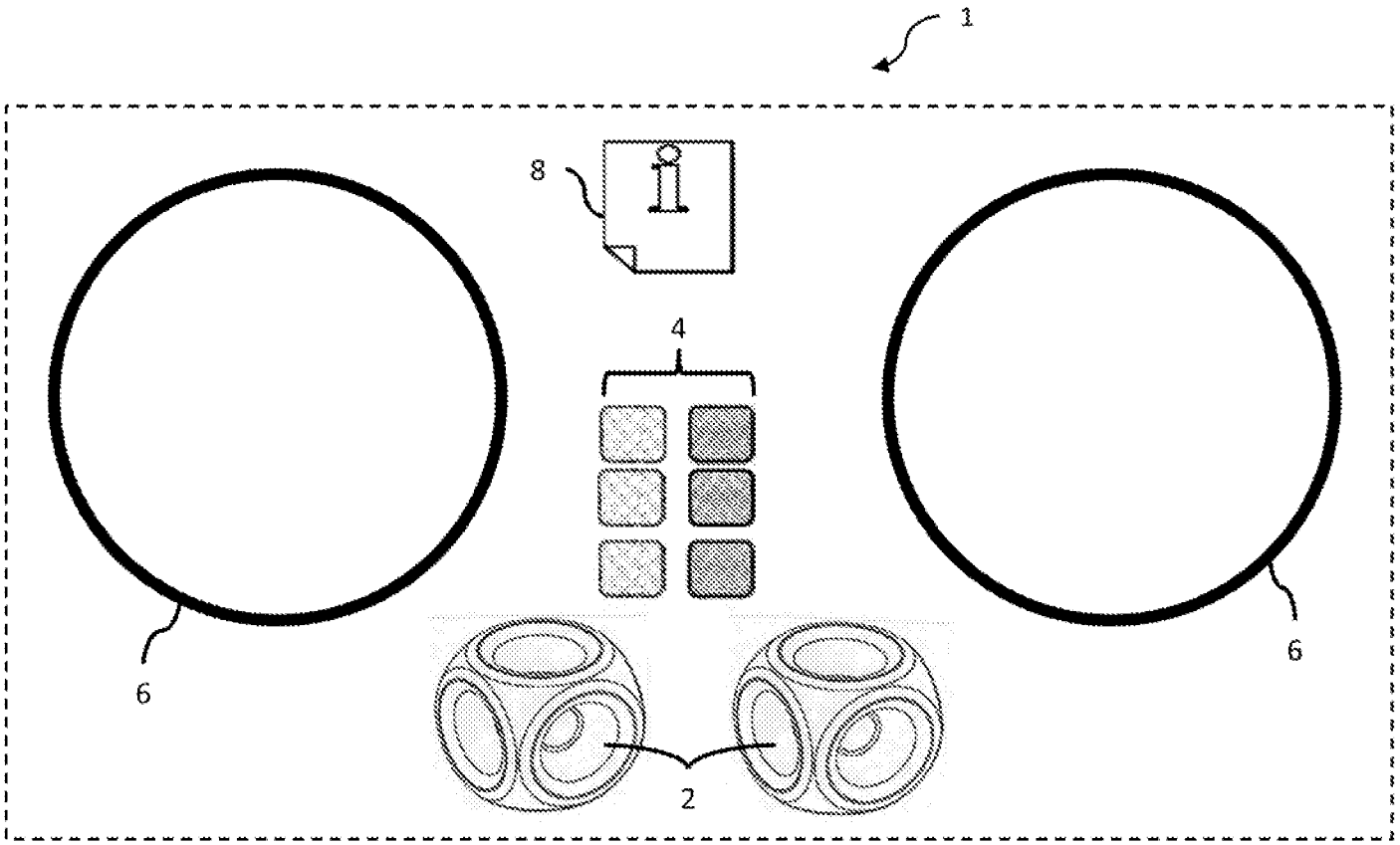
FIG. 1 shows one embodiment of the various components of the gaming kit of the present invention, including the target zone markers, the rolling pieces, the tossing pieces, and a set of instructions outlining the particular method for gameplay.

Generally speaking, the present invention is directed to a gaming kit and a method of game play for a novel lawn game that includes rolling and tossing various gaming pieces toward target zones. More particularly, as shown in FIG. 1, the present invention is directed to a gaming kit 1 including a number of rolling pieces 2, a number of tossing pieces 4, and a number of target zone markers 6, and a set of instructions 8 providing steps for gameplay, each of these components being utilized by two or more players (the players being divided into teams) to score points based on where and in what position the rolling pieces 2 and tossing pieces 4 land with relation to one another and with relation to the target zones defined by the target zone markers 6. Each of the various components and the preferred method of gameplay are described more fully below with regard to the figures.

Figure 2:
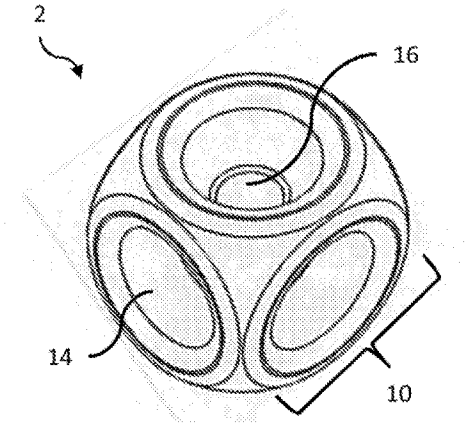
FIG. 2 shows an upward perspective view of one embodiment of a rolling piece of the present invention.
Figure 3:
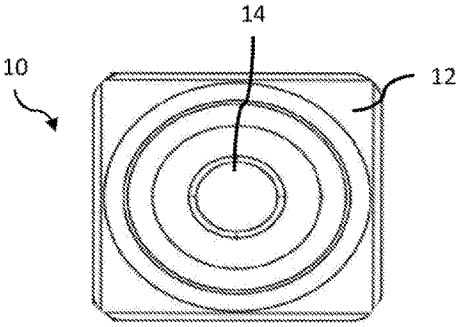
FIG. 3 shows a top view of one embodiment of the rolling piece of the present invention.

With regard to FIGS. 2-3, the preferred embodiment of the rolling pieces 2 included in the gaming kit 1 of the present invention may be described. In the preferred embodiment, as shown, the rolling pieces 2 of the gaming kit of the present invention are generally cube-shaped rolling pieces 2 with a six sides 10 (similar to but much larger than a standard gaming die), each of the sides 10 having a face surface 12. In the preferred embodiment, each of the side surfaces 12 includes a recessed portion 14 of sufficient size for receiving one or more of the tossing pieces 4 during gameplay. The recessed portion 14 preferably extends in a generally conical shape (see FIG. 2) with a large circular opening at the upper end of the recessed portion and a smaller circular face at the lower end of the recessed portion (see FIG. 3), with side surfaces of gradually smaller diameter size being positioned therebetween. For gameplay purposes, each side of the rolling pieces 2 has a scoring number 16 corresponding to the particular side 10 of the rolling piece 2 (i.e., a first side of the rolling piece has the number 1, a second side has the number 2, and so on). The scoring number 16 is positioned inside the recess 14 of the side 10 and displayed for the game players to see. It is preferable for game play purposes that two rolling pieces 2 be included in the gaming kit 1, with each of the rolling pieces 2 having a different color, pattern, or other identifying characteristic such that each of the rolling pieces 2 is associated with a different player (or different team of players). Each rolling piece 2 is configured to be rolled across the gaming surface until it reaches a resting place, as described more fully below with regard to the preferred method of gameplay. In one embodiment, the rolling pieces 2 are substantially cube shaped with each side 10 being approximately 12.5" in height and width, with the recessed portion 14 having a maximum diameter (upper end) of approximately 8" and a minimum diameter (lower end) of approximately 3.96".

Figure 6:
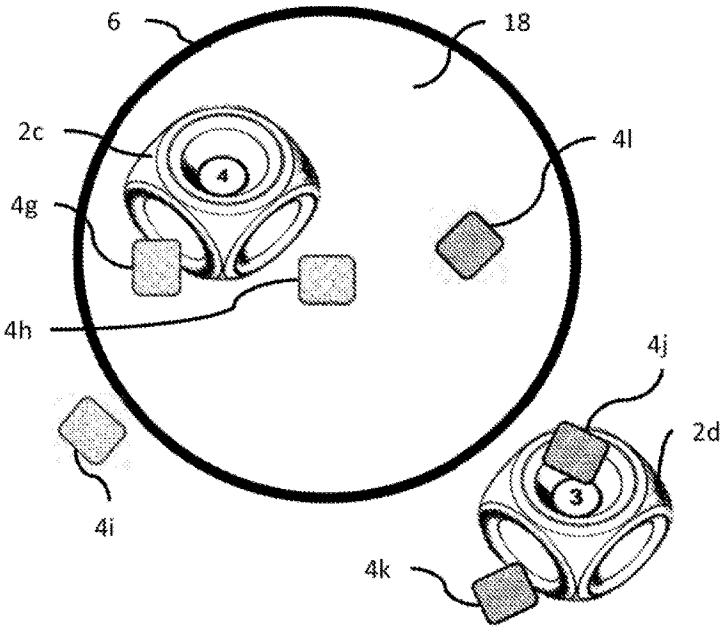
FIG. 6 shows a second example of rolling pieces and tossing pieces positioned in various scoring and non-scoring positions at the gaming assembly.
Figure 5:
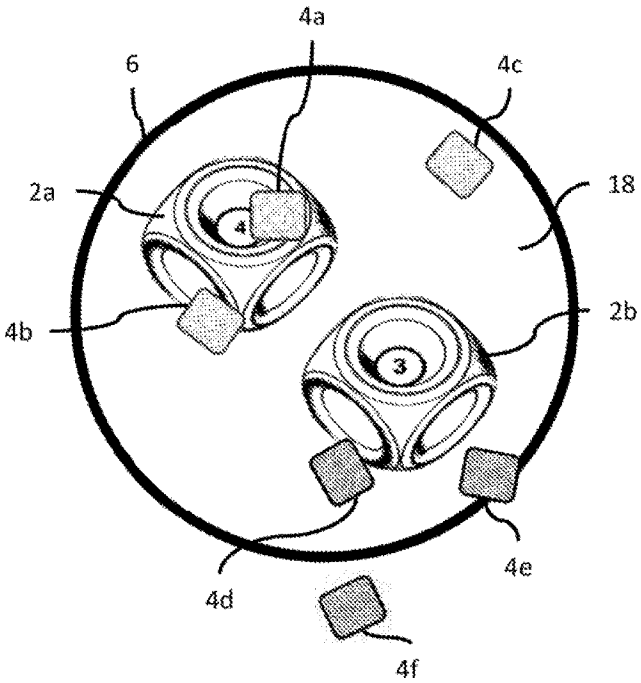
FIG. 5 shows an example of rolling pieces and tossing pieces positioned in various scoring and non-scoring positions at the gaming assembly.

In addition to the rolling pieces 2, the gaming kit 1 of the present invention also includes a number of tossing pieces 4, as shown in FIGS. 1 and 5-6. While in the preferred embodiment the tossing pieces 4 are lightweight bags made of durable material with internal weighted constituents (such as a bean bag), any tossing piece 4 may be utilized such as bags, washers, etc. The tossing pieces 4 are intended to be used during gameplay, as described more fully below, to be thrown toward the rolling pieces 2 positioned at their resting positions with respect to a number of target zones defined by the target zone markers 6, with points being awarded to the tossing player depending on where the tossing pieces 4 land in relation to the rolling piece 2 corresponding to that player or team. In the preferred embodiment, the gaming kit 1 includes six tossing pieces 4, with the tossing pieces 4 being divided into two groups of three. Each group of tossing pieces 4 is preferably marked by a different color, pattern, or other identifying characteristic (with each group corresponding to a different player or different team of players) such that during gameplay players are easily able to identify the tossing pieces 4 they have thrown. It is preferred that the color, pattern, or other identifying characteristic of each group of tossing pieces 4 matches the color, pattern, or other identifying characteristic of each of the rolling pieces 2, such that it is easy to determine which rolling piece 2 corresponds to which tossing pieces 4 of the same player or team. While the tossing pieces 4 may take any shape or form so long as they are capable of being tossed easily by the user, it is necessary that the tossing pieces 4 be no larger than the size of the recess portion 14 in the sides 10 of the rolling pieces 2, as the tossing pieces 4 must be capable of landing in (and coming to rest in) the recessed portions 14 of the rolling pieces 2.

Figure 4:
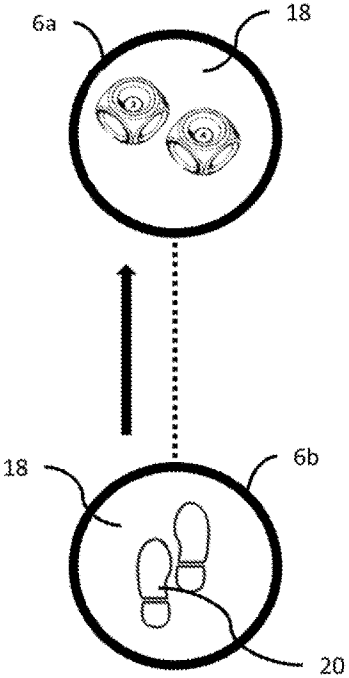
FIG. 4 shows one embodiment of gameplay setup for the present invention, showing a starting position in one target zone marker and gameplay direction toward the other target zone marker.

Finally, in addition to the rolling pieces 2 and tossing pieces 4, the gaming kit 1 of the present invention includes one or more target zone markers 6, as shown in FIGS. 1 and 4-6. Each of the target zone markers 6 is to be used during gameplay for marking a specific area 18 on the gaming surface that will be deemed the "target zone." The target zone's 18 purpose during gameplay is described in more detail below with regard to the preferred method of game play. In the preferred embodiment, each target zone marker 6 is a large circular hoop that is configured to be placed flat on the gaming surface. While the target zone marker 6 may be a number of shapes and sizes, it is necessary that the target zone marker 6 be of sufficient size such that the target zone area 18 within the target zone marker 6 is sufficiently large to allow space for the rolling pieces 2 and tossing pieces 4 to land within the target zone 18. As such, one possible size of the target zone marker 6 is approximately 60 inches in diameter. In one embodiment the gaming kit 1 of the present invention includes two target zone markers 6, which are configured to be placed a certain distance apart on the gaming surface depending on desired gameplay (as shown in FIG. 4). Still, the game may also be played with only one target zone marker 6 or with more than two with only slight modifications to the game play.

Having described the components included in the gaming kit 1 of the present invention, the preferred method of gameplay may now be described. Set-up and preparation for gameplay utilizing the instructions 8 included in the gaming kit 1 of the present invention is minimal. All that is required is an open area (preferably substantially flat) large enough to handle a fairly large field of play (hereinafter referred to as the "gaming surface"). A field, yard, parking lot, or other large flat area is preferable. The most preferable gaming surface would have an area of approximately 60 feet by 30 feet for game play. The only step for set-up requires that the target zone markers 6 to be placed a certain distance apart on the gaming surface (with the distance varying by desired gameplay and game experience), an example of which is shown in FIG. 4. For example, a beginner level game might have the target zone markers 6 placed at approximately 15 feet apart, intermediate may place the markers 6 approximately 24 feet apart, and advanced may place the markers 6 approximately 30 feet apart. Of course, the distance can be modified by the particular game players to better obtain a distance that works with their skill level. The game could even be played indoors, provided that a sufficiently large area is available for safe play.

Once the target zone markers 6 are placed on the gaming surface at an appropriate distance according to the skill level of the players, gameplay is ready to begin. For example purposes, the method of gameplay may be described with reference to a "player" taking an action; however, gameplay may also occur with teams of players. Each player selects a rolling piece 2 and the tossing pieces 4 corresponding to that rolling piece 2. Each player then rolls his or her rolling piece 2 to determine who starts gameplay. The player who rolls the highest number (i.e. their rolling piece 2 lands with the highest number 16 face up) goes first. Play starts with the players standing at one end of the gaming surface, with the direction of play being toward the target zone 18 at the opposite end. The first player stands at a starting position 20 inside the target zone marker **6*b* at the starting end of the gaming surface and rolls their rolling piece 2 toward the other target zone marker 6*b* (the direction of play for the first round is shown in FIG. 4). The rolling player must stay inside the starting target zone marker 6*b* or else their roll will be considered a foul (which is scored as a zero and counts as a non-scoring roll). Depending on where the rolling piece 2 comes to rest on the gaming surface, the player's roll is considered either a "scoring roll" or a "non-scoring roll." A "scoring roll" is a roll by which the rolling piece 2 makes it at least half way between the two target zone markers 6*a*, 6*b*. A roll where the rolling piece 2 does not make it at least half way between the two target zone markers 6*a*, 6*b* is considered a "non-scoring roll" and the player (or team) associated with that rolling piece 2 loses their turn. The "scoring roll" category can be broken down into two sub-categories: a "qualified roll" and "a non-qualified roll." A qualified roll is a scoring roll where the rolling piece 2 has come to rest inside the target zone marker 6 (see FIG. 5), while a non-qualified roll is a scoring roll where the rolling piece 2*a* has come to a rest outside of the target zone marker 6 (see, for example, rolling piece 2*d* in FIG. 6**). Scoring for a roll is dependent upon whether the roll is qualified or non-qualified, as described more fully below.

Once the players have rolled, for each player that has rolled a "scoring roll" (whether qualified or non-qualified), the player continues their turn by tossing their tossing pieces 4 toward their rolling piece 2, with the object being to have their tossing pieces 4 come to rest at one of several target positions: (a) inside the recess portion of the top surface on their particular rolling piece (see, for example, tossing piece **4*a* in FIG. 5), (b) on the gaming surface but leaning against their particular rolling piece (see, for example, tossing pieces 4*b* and 4*d* in FIG. 5), (c) on the gaming surface within a certain distance (such as a bags width or approximately 6 inches) of the rolling piece but not touching the rolling piece (see, for example, tossing piece 4*e* in FIG. 5), or (d) on the gaming surface but not within a certain distance of the rolling piece (see, for example, tossing pieces 4*c* and 4*f* in FIG. 5). As described more fully below, scoring is dependent upon in which of these target positions the tossing pieces 4 land. Furthermore, tossing pieces 4 that land inside the top recess portion 14 of the player's rolling piece 2 fall into one of two-categories: "qualified toss" or a "non-qualified toss." A qualified toss is a toss where the tossing piece 4 lands in the recess 14 of a rolling piece 2 considered a qualified roll (see, for example, tossing piece 4*a* in FIG. 5, where the tossing piece 4*a* has landed in the recess portion 14 of a rolling piece 2*a* inside of the target zone 18), whereas a non-qualified toss is a toss where the tossing piece 4 lands in the recess 14 of a rolling piece 2 considered a non-qualified roll (see, for example, tossing piece 4*j* in FIG. 6, where the tossing piece 4*j* has landed in the recess 14 of a rolling piece 2***d* outside of the target zone 18). The score for a particular toss is dependent upon where the tossing piece 4 lands and if it is a qualified or non-qualified toss. Once all rolling pieces 2 have been rolled and all tossing pieces 4 have been tossed, the round is over and scores are calculated. Once scores are calculated, the players begin another round, this time starting at the second target zone 6*a* and rolling/tossing pieces back toward the original starting target zone 6*b*. Play continues, alternating between target zones 18, until a desired winning score is reached.

Scoring for gameplay utilizing the gaming kit and components of the present invention is fairly simple. As noted above, play begins by rolling the rolling pieces 2 toward the appropriate target zone marker 6. A rolling piece 2 can either be considered a "scoring roll" or a "non-scoring roll" and a scoring roll can be broken down further into a "qualified roll" and a "non-qualified roll." A qualified roll, as mentioned above, is a rolling piece 2 that comes to rest inside the target zone marker (see, for example, rolling pieces 2*a* and 2*b* of FIG. 5). A qualified roll awards the rolling player points corresponding to the number 16 positioned on the face-up side 10 of the rolling piece 2 when the rolling piece 2 comes to rest (i.e., a number between 1 and 6). A non-qualified roll, or a rolling piece 2 that comes to rest outside the target zone 18 (see, for example, rolling piece 2*d* in FIG. 6) awards no points to the rolling player. Once the rolling pieces 2 have come to a rest, players take turns tossing their tossing pieces 4 toward the rolling pieces 2. As indicated above, tossing pieces 4 can come to rest in a number of target locations. First, a tossing piece 4 could come to rest on or in the recess portion 14 of the face-up surface 10 of a rolling piece 2 (tossing pieces 4*a* of FIGS. 5 and 4*j* of FIG. 6, for example). If the rolling piece 2 is a qualified roll (rolling piece 2*a* in FIG. 5), the tossing piece 4*a* falling into the recess 14 is deemed a qualified toss and is awarded a higher amount of points (in one embodiment, four points is awarded). If the tossing piece 4 falls into the recess 14 portion of a non-qualified rolling piece 2 (see, for example, rolling piece 4*j* in non-qualified rolling piece 2*d* of FIG. 6), the player who threw the tossing piece 4*j* is awarded a non-qualified tossing score, which is a score slightly lower than the qualified tossing score (in one embodiment, three points is awarded). A tossing piece 4 could, instead of landing in the recessed portion of the rolling piece 2, land in a position such that it is in contact with the rolling piece 2 (which may be referred to as a "leaner"). Examples of "leaners" are shown with tossing pieces 4*b* and 4*d* in FIG. 5, where the tossing pieces 4*b*, 4*d* have landed in a position touching rolling pieces 2*a*, 2*b* but not in the recess 14 of the rolling pieces 2*a*, 2*b*. In such a case, the player(s) associated with the particular tossing piece 4*b*, 4*d* is awarded a lower point amount (such as two points). Alternatively, the tossing piece 4 could land in a position such that it is close to the rolling piece 2 (within a few inches, for example) but is not in contact with the rolling piece 2. Such a tossing piece may be referred to as a "bagger" and awards the tossing player the lowest amount of points (for example, one point). Example scoring positions for "baggers" are shown by tossing piece 4*e* in FIG. 5 and tossing piece 4*h* in FIG. 6. Finally, a tossing piece 4 could land in a position such that it is neither in contact with a rolling piece 2 nor in close proximity to the rolling piece 2. Examples include tossing pieces 4*c*, 4*f*, 4*i*, and 4*l*. Such a tossing piece 4 is awarded zero points. Once all rolling pieces 2 have been rolled and all tossing pieces 4 have been tossed, points are calculated for each player and play continues to the next round. In one embodiment, play continues until a player reaches twenty-one points.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. When a Markush group or other grouping is used herein, all individual members of the group and all combinations and subcombinations possible of the group are intended to be individually included. All references cited herein are hereby incorporated by reference to the extent that there is no inconsistency with the disclosure of this specification. When a range is stated herein, the range is intended to include all sub-ranges within the range, as well as all individual points within the range. When "about," "approximately," or like terms are used herein, they are intended to include amounts, measurements, or the like that do not depart significantly from the expressly stated amount, measurement, or the like, such that the stated purpose of the apparatus or process is not lost.

The present invention has been described with reference to certain preferred and alternative embodiments that are intended to be exemplary only and not limiting to the full scope of the present invention, as set forth in the appended claims.

I claim:

1. A gaming kit for use by at least two players for playing a tossing and rolling game on a gaming surface, the gaming kit comprising:

a. at least one target zone marker configured to be placed on the gaming surface, wherein each of the at least one target zone markers is further configured to identify a target zone area on the gaming surface;

b. one rolling piece comprising at least six side face surfaces, wherein each of the at least one rolling pieces is configured to be rolled across the gaming surface toward the target zone markers and come to rest at a resting point on the gaming surface relative to one of the at least one target zone markers; and c. at least one tossing piece configured to be tossed toward one of the rolling pieces on the gaming surface, wherein each of the at least one tossing piece is configured to land at one of a plurality of landing positions relative to the at least one rolling piece, wherein at least a portion of the side face surfaces of each of the at least one rolling pieces comprises a recessed portion configured to act as a compartment for receiving the at least one tossing piece.

2. The gaming kit of claim 1, wherein each of the at least one target zone markers comprises a circular ring.

3. The gaming kit of claim 1, wherein the at least one target zone marker comprises at least two target zone markers.

4. The gaming kit of claim 3, wherein the at least two target zone markers are positioned on the gaming surface a distance apart.

5. The gaming kit of claim 1, wherein the at least one rolling piece comprises at least two rolling pieces.

6. The gaming kit of claim 1, wherein each of the recessed portions of the side face surface of the at least one rolling piece comprises a scoring number associated with the particular side face surface of the rolling piece.

7. The gaming kit of claim 1, wherein the at least one tossing piece comprises at least six tossing pieces.

8. The gaming kit of claim 1, wherein the at least one tossing piece each comprise bags.

9. The gaming kit of claim 1, wherein the number of landing positions relative to a particular one of the at least one rolling piece includes (a) inside the recessed portion of a top-up side of each rolling piece at the resting position, (b) at a position on the gaming surface where the particular tossing piece touches the particular rolling piece at the resting position, (c) at a position on the gaming surface where the particular tossing piece is near to but not touching the particular rolling piece at the resting position, and (d) at a position on the gaming surface where the particular tossing piece is neither near to or touching the particular rolling piece at the resting position.

10. A method of playing a tossing and rolling game on a gaming surface, the method comprising the steps of:

a. positioning a first target zone marker on the gaming surface;

b. from a first starting position a distance from the first target zone marker, rolling a rolling piece toward the first target zone marker, wherein the rolling piece comprises six side surfaces having recessed portions, and wherein the rolling piece is configured to roll across the gaming surface until it reaches a resting point on the gaming surface relative to the first target zone marker such that one of the side surfaces is positioned face-up when the rolling piece reaches the resting point;

c. once the rolling piece has reached the resting point on the gaming surface, tossing a number of tossing pieces toward the rolling piece, wherein each of the number of tossing pieces is configured to land at one of a number of landing positions relative to the rolling piece, wherein one of the number of landing positions comprises the tossing piece coming to rest in the recessed portion of the face-up side surface of the rolling piece; and d. calculating a score depending on the resting point of the rolling piece relative to the first target zone marker and the landing positions of each of the tossing pieces relative to the rolling piece.

* * * * *